United States Patent [19]

Knudson

[11] Patent Number: 4,621,511

[45] Date of Patent: Nov. 11, 1986

[54] METHOD AND APPARATUS FOR FORMING LOOSELY CONNECTED ARTICLES

[76] Inventor: Gary A. Knudson, 17356 W. 57th Ave., Golden, Colo. 80401

[21] Appl. No.: 719,513

[22] Filed: Apr. 3, 1985

[51] Int. Cl.[4] ..... B21D 28/10

[52] U.S. Cl. ..... 72/186; 72/129; 72/177; 83/865

[58] Field of Search ..... 72/129, 130, 177, 185, 72/186, 187; 83/862, 863, 865, 301, 345

[56] References Cited

U.S. PATENT DOCUMENTS

| | | | |
|---|---|---|---|
| 1,462,138 | 7/1923 | Langston . | |
| 1,487,662 | 3/1924 | Langston . | |
| 1,969,433 | 8/1934 | Smitmans | 83/345 |
| 2,083,370 | 6/1937 | Greulich | 72/186 |
| 2,222,842 | 11/1940 | Humphrey | 83/865 |
| 2,246,957 | 6/1941 | Shields | 83/345 |
| 2,481,138 | 9/1949 | Mercer | 72/247 |
| 2,568,333 | 9/1951 | Henschker et al. | 83/345 |
| 2,728,982 | 1/1956 | Merrill | 72/186 |
| 3,985,054 | 10/1976 | Marino | 83/345 |

FOREIGN PATENT DOCUMENTS

| | | | |
|---|---|---|---|
| 1022896 | 1/1958 | Fed. Rep. of Germany | 83/862 |

*Primary Examiner*—Lowell A. Larson

*Attorney, Agent, or Firm*—Fields, Lewis, Pittenger & Rost

[57] ABSTRACT

A punch and shear machine (27) has a pair of rotary punch drums (35, 36) succeeded by a pair of rotary shear drums (38, 39). The machine (27) receives a strip of sheet material (31) and forms in the strip a series of fastener-receiving indentations (51) and a series of alined pairs of slits (110) each with an intermediate scored portion (111). The sheared strip is then passed through a roll-forming machine (28) to form a strip of loosely connected hold-down clips (150) for roof panels and the like.

15 Claims, 27 Drawing Figures

3
3
150
28
29
27
40
114
112
118
119
69
68
70
56
54
55
57
61
38
35
34
41
33
32
31
123
71
63
77
64
65
66
67

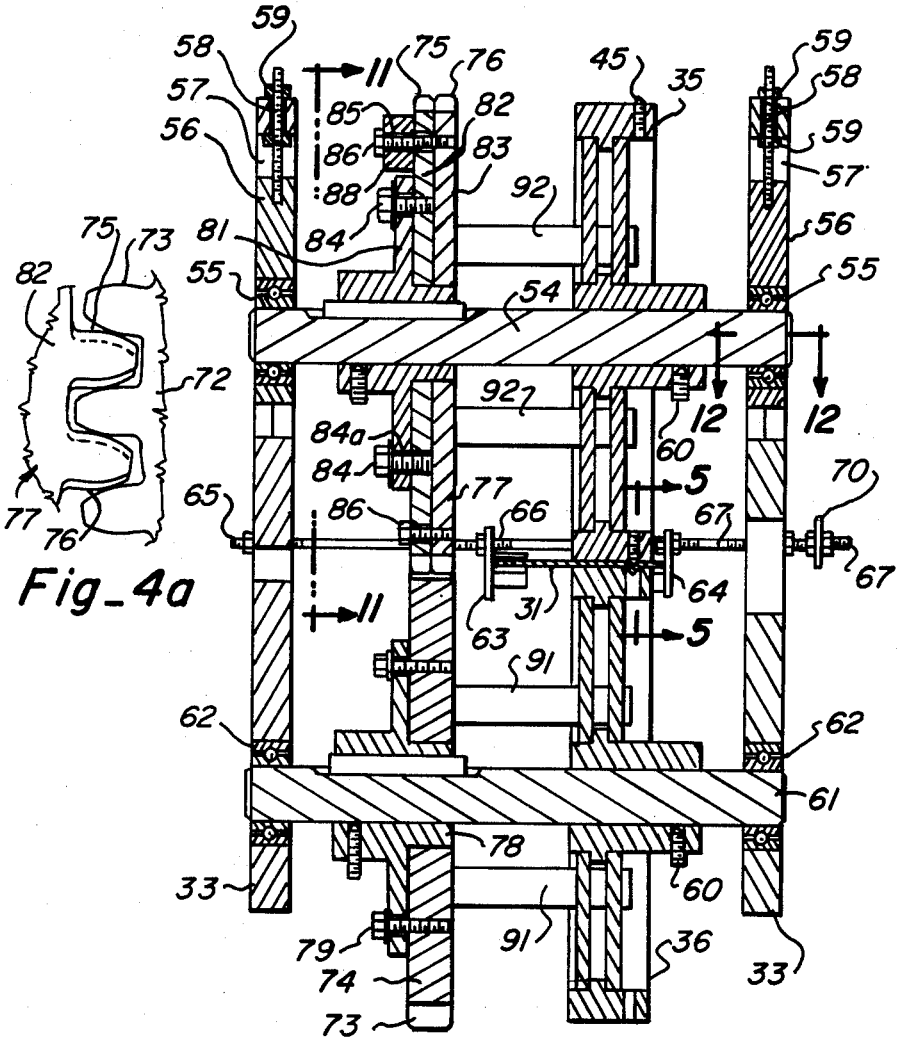
Fig_4a
Fig_4
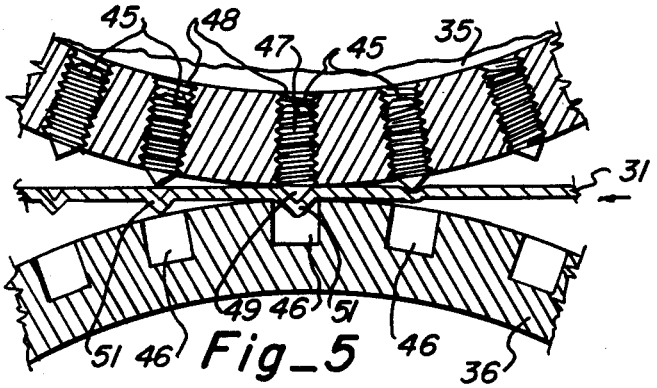
Fig_5

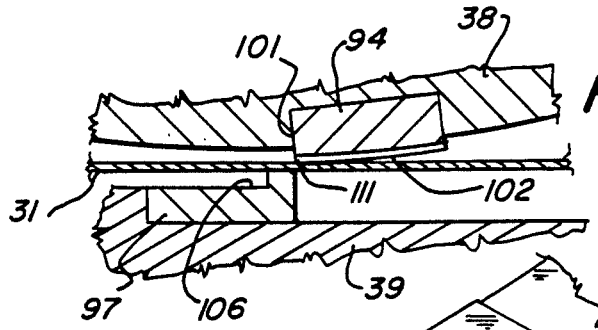
Fig_17
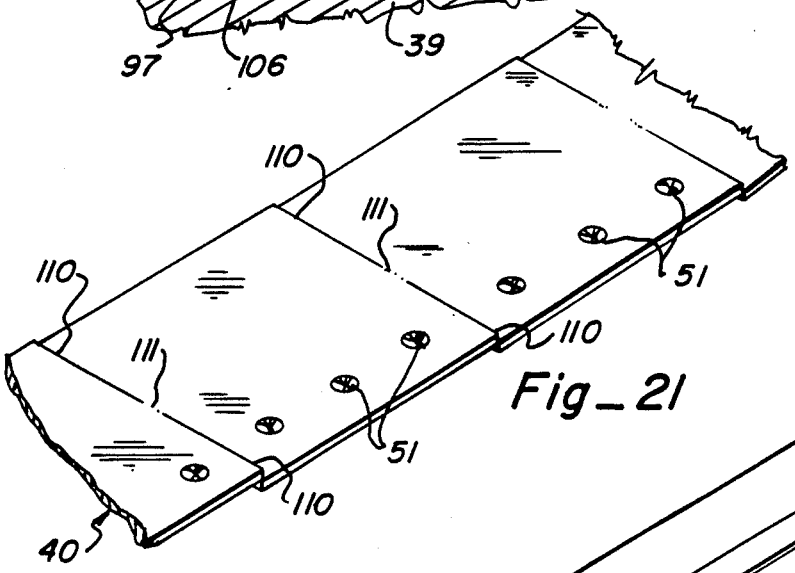
Fig_21
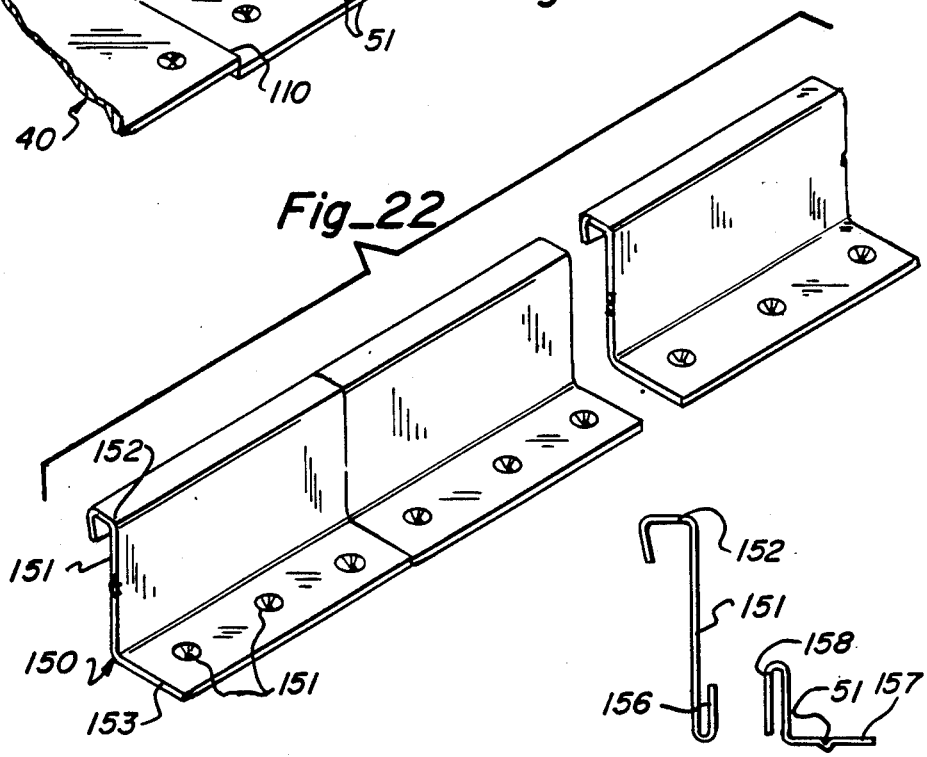
Fig_22
Fig_23

METHOD AND APPARATUS FOR FORMING LOOSELY CONNECTED ARTICLES

TECHNICAL FIELD

This invention relates to a novel and improved method and apparatus for making loosely connected articles and particularly hold-down clips for roof panels and the like.

BACKGROUND ART

Hold-down clips have heretofore been used to secure metal panels to a supporting structure. Reusser U.S. Pat. No. 4,337,606 shows an example of such a hold-down clip. Applicant discloses a two-part hold-down clip in a copending application entitled "Two-Part Hold-Down Apparatus with Slip Joint for Seamed Panel Assemblies."

In the past hold-down clips have generally been formed one at a time in a punch press operation. No known prior art is specifically adapted to receive a strip of sheet metal and continuously form a series of loosely connected hold-down clips that are readily broken off from the strip for required use.

Langston U.S. Pat. Nos. 1,462,138 and 1,487,662 disclose apparatus which includes cooperating pairs of rotating drums with cutting edges on dies into which a strip of material is fed to make composition shingle strips having slots, holes, etc.

DISCLOSURE OF INVENTION

Rotary shear apparatus disclosed includes a set of shear drums rotated in synchronism each with a plurality of circumferentially spaced shear blades with cooperating pairs having surfaces that form a series of pairs of slots with an intermediate score portion as the strip is moved continuously therethrough. A set of punch drums preceding the shear drums rotated in synchronism form a series of fastener-receiving impressions in the strip. Roll-forming apparatus receives the sheared strip and shapes it into a strip of loosely connected hold-down clips that are readily broken apart by hand-twisting, usually at the point of use.

BRIEF DESCRIPTION OF DRAWINGS

The details of this invention will be described in connection with the accompanying drawings, in which:

FIG. 4 is a sectional view taken along lines 4—4 of FIG. 3;

FIG. 4*a* is a fragmentary side elevational view showing the meshing of the upper and lower gears of FIG. 4;

FIG. 5 is a sectional view taken along lines 5—5 of FIG. 4;

FIG. 17 is a sectional view taken along lines 17—17 of FIG. 15;

FIG. 21 is a perspective view of the strip of loosely connected articles that exits the punch and shear machine;

FIG. 22 is a perspective view of hold-down clip articles that exit the roll-forming machine;

FIG. 23 is an illustration of the shapes of a two-part clip that can be made from apparatus according to the present invention;

DETAILED DESCRIPTION

Figures 1, 2:
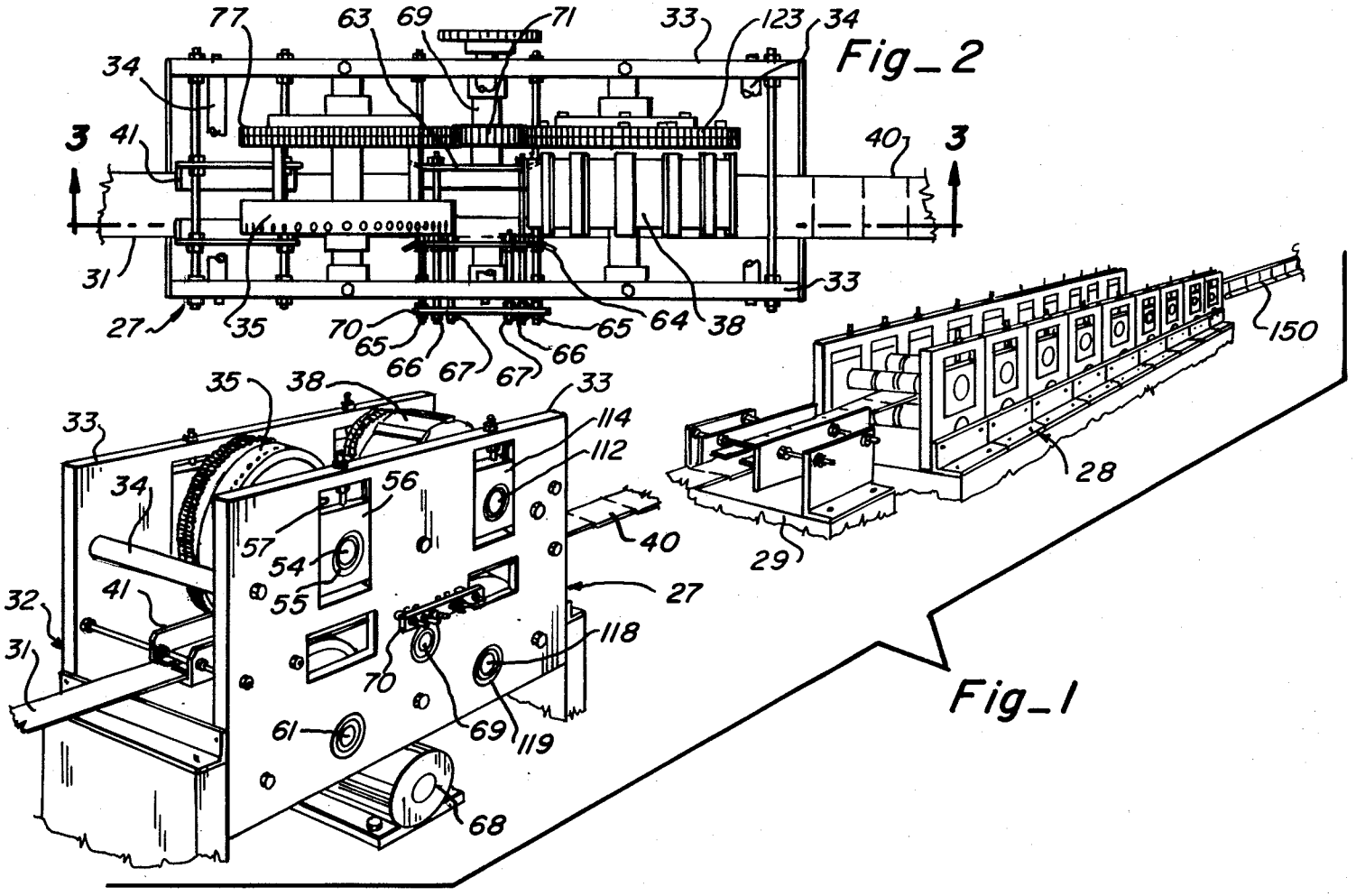
FIG. 1 is a perspective view of apparatus embodying features of the present invention.
FIG. 2 is a top plan view of the combination punch and shear machine shown in FIG. 1.

The apparatus shown in FIG. 1 includes a combination punch and shear machine 27 and a roll-forming machine 28 with a guide station 29 between machines 27 and 28 to guide the material from machine 27 into machine 28. A feed strip of material 31, typically a strip of sheet metal of a selected thickness and of a selected width and length is fed into machine 27 wherein a sheared strip 40 is formed, fed through guide station 29, and into machine 28, which in turn forms a strip of loosely connected hold-down clips 150.

The punch and shear machine 27 has a support frame 32 inclusive of parallelly spaced side plates 33 connected by a plurality of cross members 34. Machine 27 has a set of transversely extending upper and lower rotary punch drums 35 and 36, respectively, that rotate about parallel axes and a set of transversely extending upper and lower rotary shear drums 38 and 39, respectively, downstream of drums 35 and 36 that also rotate about parallel axes. The punch drums are shown preceding the shear drums, but it is understood that for some shearing applications the punch drums could be eliminated or not used or, further, could succeed the shear drums.

A material guide 41 is shown directing strip 31 between drums 35 and 36, a material guide 42 is shown directing the punched strip between drums 38 and 39, and a material guide 43 is shown guiding the sheared strip 40 that axits drums 38 and 39.

The upper punch drum 35 shown carries a plurality of circumferentially spaced, radially disposed, male dies 45. The lower rotary drum carries a plurality of circumferentially spaced, radially disposed, female dies 46 in the form of holes.

Figure 3:
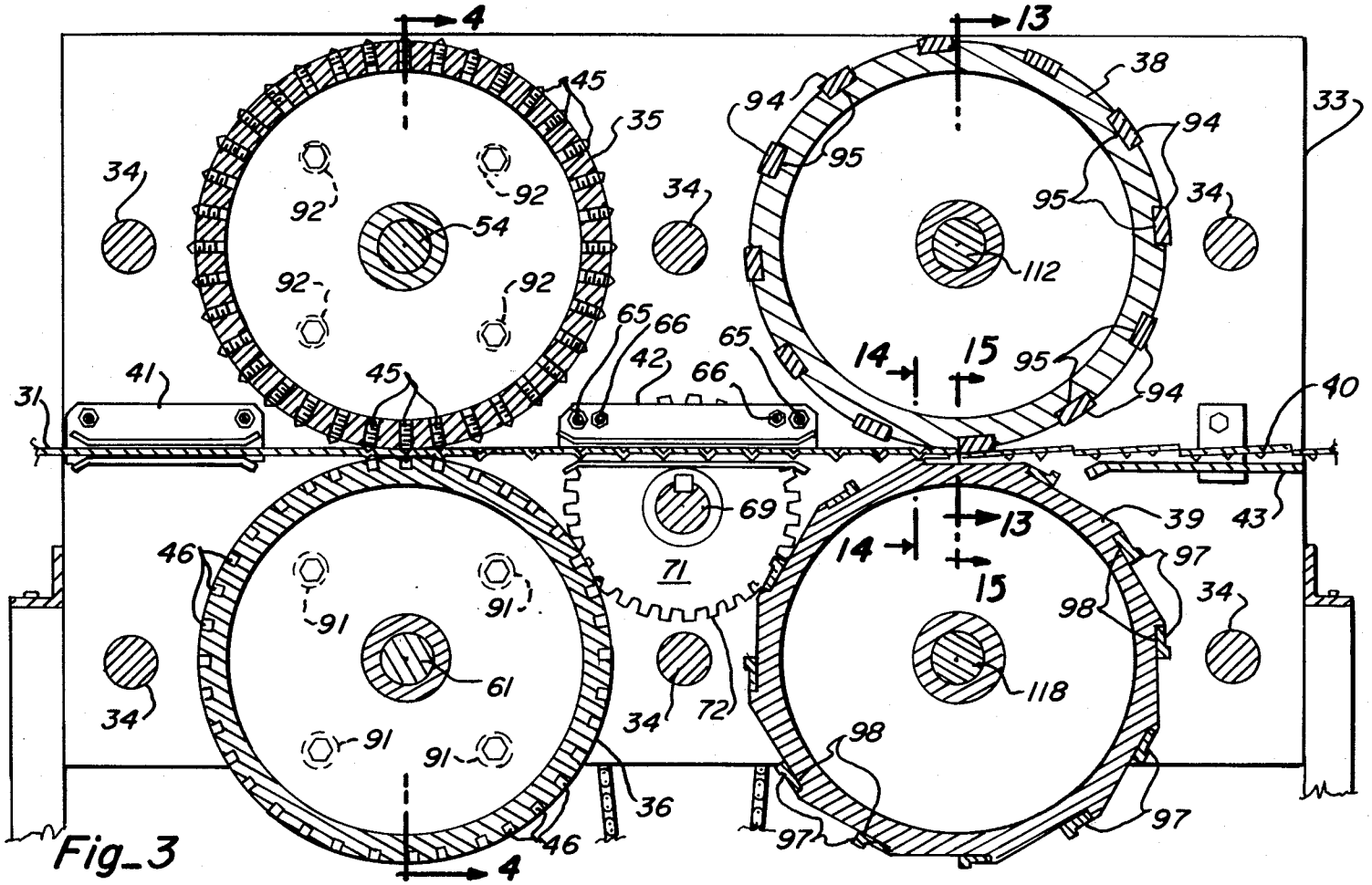
FIG. 3 is a sectional view taken along lines 3—3 of FIG. 2.

As seen in FIGS. 3 and 5, the male die 45 has external threads 47 that thread into a hole with internal threads 48 in drum 35 and has a tapered projection 49 that extends into the hole 46 in the opposite drum to form a fastener-receiving indentation 51 in the sheet material that does not pierce the material and is suitable for the use of screws to anchor the article to a base. The drums 35 and 36 are timed in relation to each other so that male die 45 and female die 46 are coaxially alined in forming the impression.

Figure 6:
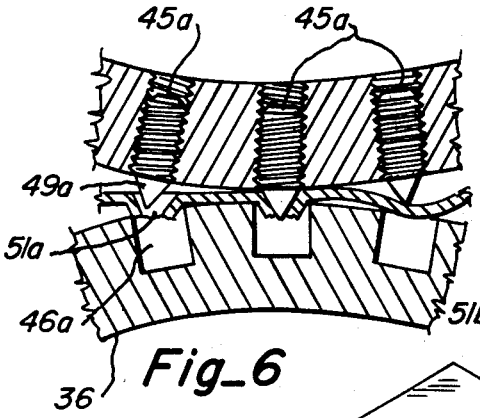
FIG. 6 is a sectional view showing an alternative form of punching dies that pierce the strip.

The variation of the male die 45*a* shown in FIG. 6 has a larger tapered projection 49*a* and the female die 46*a* is enlarged so that the alined opposite dies form perforations 51*a* in the strip 31. These perforations will accommodate the receipt of nail fasteners or the like.

Figure 7:
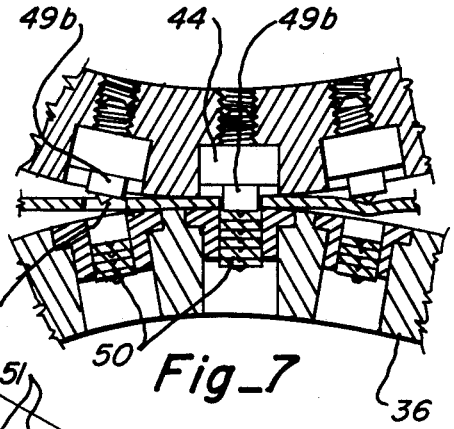
FIG. 7 is a sectional view showing yet another form of punching dies that form holes in the strip.
Figure 8:
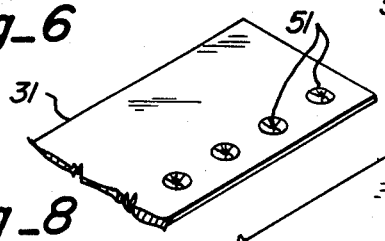
FIG. 8 is a perspective view of the strip with the indentations as formed by the dies shown in FIG. 5.
Figure 9:
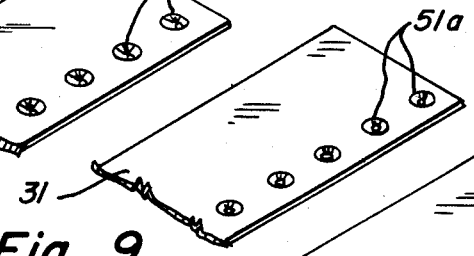
FIG. 9 is a perspective view of a strip which has tapered holes formed by the dies shown in FIG. 6.
Figure 10:
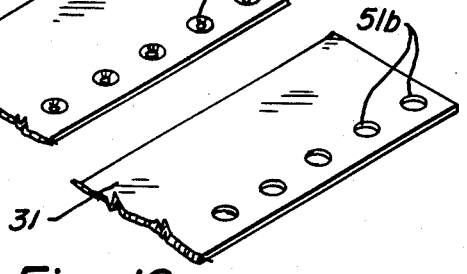
FIG. 10 is a perspective view of a strip with holes formed by the dies shown in FIG. 7.

A further variation of the male die shown in FIG. 7 is a cylindrical projection 49*b* on an enlarged base portion 44 with a threaded end portion, and the female die 46*b* is in the form of a stepped bushing that is force-fitted into a radial hole in the drum 36. These alined opposite dies form circular holes 51*b* in the strip, leaving punched-out disks 50 in the hole of the female die 46*b*.

Figure 12:
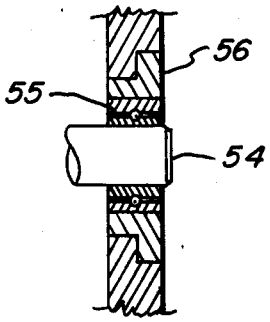
FIG. 12 is a sectional view taken along lines 12—12 of FIG. 4.
Figure 13:
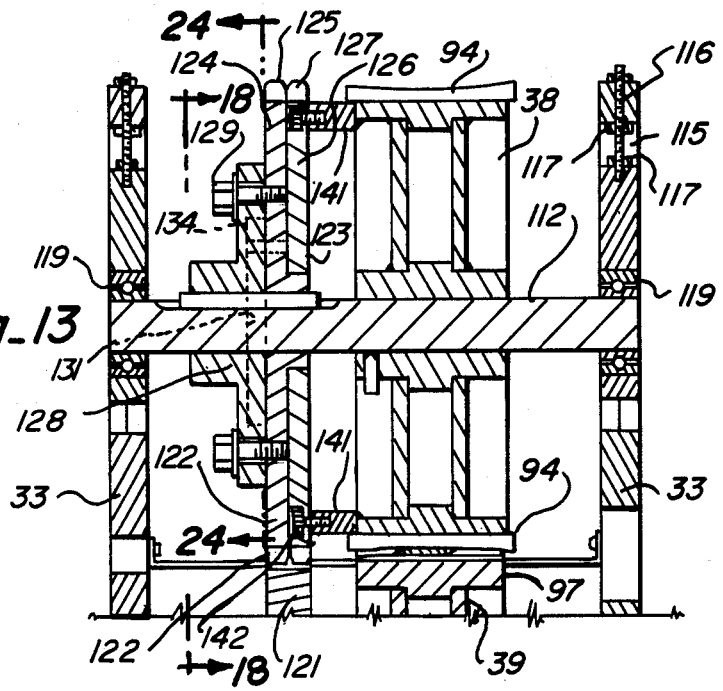
FIG. 13 is a sectional view taken along lines 13—13 of FIG. 3.
Figure 14:
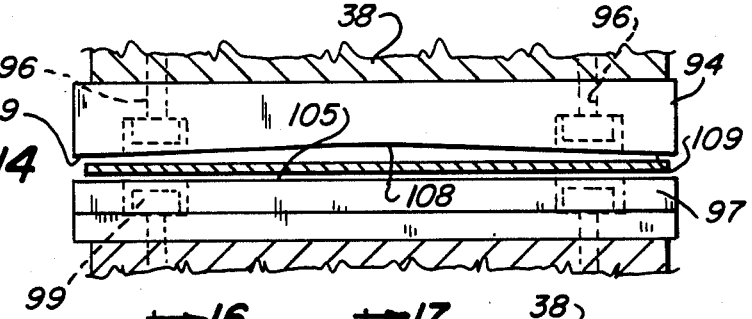
FIG. 14 is a sectional view taken along lines 14—14 of FIG. 3.
Figure 15:
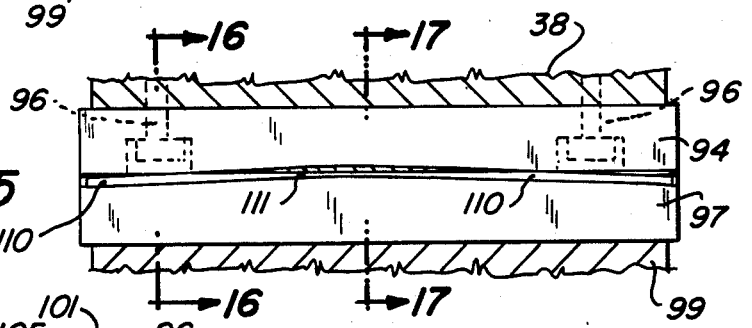
FIG. 15 is a sectional view taken along lines 15—15 of FIG. 3.
Figure 16:
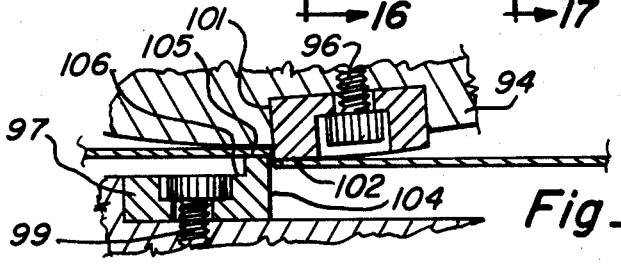
FIG. 16 is a sectional view taken along lines 16—16 of FIG. 15.

The upper punch drum 35 is mounted on an upper shaft 54 having its end portions journaled in bearings 55 in adjustable slide blocks 56 slidable for guided movement in rectangular windows 57 in the side plates 33. The slide blocks 56 have stepped side edges, as seen in FIG. 12.

The elevation of each slide block 56 is adjustable through a range of movement and held at a selected setting to change the spacing between the two punch drums 35 and 36 to accommodate strips of different thicknesses. This is accomplished by means of an externally threaded rod 58 that extends down through a hole in the top of the side plate and threads into an internally threaded hole in the top of the slide block so that as the rod is rotated the block moves up or down. Upper and lower lock nuts 59 on the rod are used to lock the block in a selected elevation. The lower punch drum 36 is mounted on a lower shaft 61 having its ends journaled in bearings 62 in the side plates.

The upper and lower punch drums 35 and 36 are adjustable laterally along their respective support shafts and are held at a selected setting to locate the punch dies at a selected position laterally of the strip. To this end the drums are axially slidable on their associated shafts and are moved from a location externally of the machine by the movement of a pair of spaced side guides 63 and 64 disposed on opposite sides of the drums 35 and 36.

The lateral adjustment of the punch drums is accomplished by having an outer pair of externally threaded rods 65 extending through holes in the side plates 33 and threading through internally threaded holes in side guides 63 and 64 so that, as the threaded rods are rotated, both side guides move together laterally.

A second pair of externally threaded rods 66 extend through holes in one side plate 33, through holes in side guide 64, and connect at the ends to side guides 63 so that, as rods 66 are turned, only side guide 63 will move laterally.

A third pair of externally threaded rods 67 extend through holes in one side plate 33 and connect at the end to side guide 64 so that, as rods 67 are turned, only side guide 64 is moved laterally.

All of the end portions of the pairs of rods extend through a common exterior plate 70 and appropriate lock nuts are threaded on each to lock the side guides in the required position. Set screws 60 are shown in the drums to lock them to their associated shafts.

The drive for rotating the punch drums and shear drums includes a drive motor 68 that drives a main drive shaft 69 with a drive gear 71. The drive gear 71 has teeth 72 which mesh with teeth 73 on a lower gear 74 on lower shaft 61 which in turn meshes with split teeth 75 and 76 on upper gear 77. The lower gear 74 is on a hub 78 keyed to shaft 61 and the lower gear is secured to the hub by bolts 79.

Figure 11:
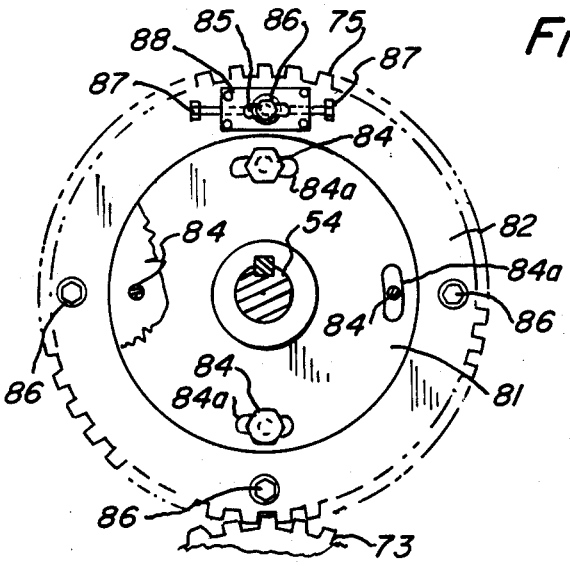
FIG. 11 is a sectional view taken along lines 11—11 of FIG. 4 with portions broken away to show interior construction.

The upper gear 73 is of the split type comprising a hub 81, an outer gear portion 82 having teeth 75, and an inner gear portion 83 having teeth 76. As seen in FIGS. 4 and 11, the hub 81 has an annular section of reduced diameter on which the gear portions will slide and are held by a radial portion of the hub. The hub 81 is keyed to the upper shaft.

The outer gear portion 82 is secured to the hub by circumferentially spaced bolts 84 in associated circumferentially spaced elongated slots 84*a* in the hub 81. The outer gear portion has circumferentially spaced elongated slots 85 through which a bolt 86 extends and threads into inner gear portion 83. Set screws 87 in a block 88 on the outer gear portion are used to shift the angular position of the outer gear portion with respect to the inner gear portion about the axis of rotation so that teeth 75 and 76 take up the full space between the teeth 73 of the lower gear, as seen in FIG. 4*a*, and thereby avoid backlash which might otherwise occur when the holes are being punched in the strip.

Circumferentially spaced axial rods 91 connect at one end to the lower gear 74 and extend through openings in the lower punch drum 36 in a close-fitting relationship to transmit the movement of the lower gear to the lower punch drum. Similarly, circumferentially spaced axial rods 92 connect at one end to the upper gear 77 and extend through openings in the upper punch drum to transmit the movement of the upper gear to the upper punch drum.

The upper shear drum 38 has a plurality of circumferentially spaced, radially disposed, shear blades 94 mounted in and projecting out from associated peripheral recesses 95 in the drum 38. The blade 94 is shown secured to the drum by a pair of bolt fasteners 96 having heads recessed in the peripheral surface of the blade.

Similarly, the lower shear drum 39 has a plurality of circumferentially spaced, radially disposed, lower shear blades 97 disposed in recesses 98 in the lower drum 39. The blade 97 is shown secured to the drums by a pair of bolt fasteners 99 having heads recessed in the peripheral surfaces of the blade.

The top shear blade 94 has a radially extending shear face 101 and a transversely extending face 102 which together form a right-angle corner. The lower shear blade 97 has a radially extending shear face 104 and a transversely extending straight surface portion 105 which together form a right-angle corner. Surface portion 105 is provided with a step 106 to accommodate the depressions 51 in the strip 31.

Figure 19:
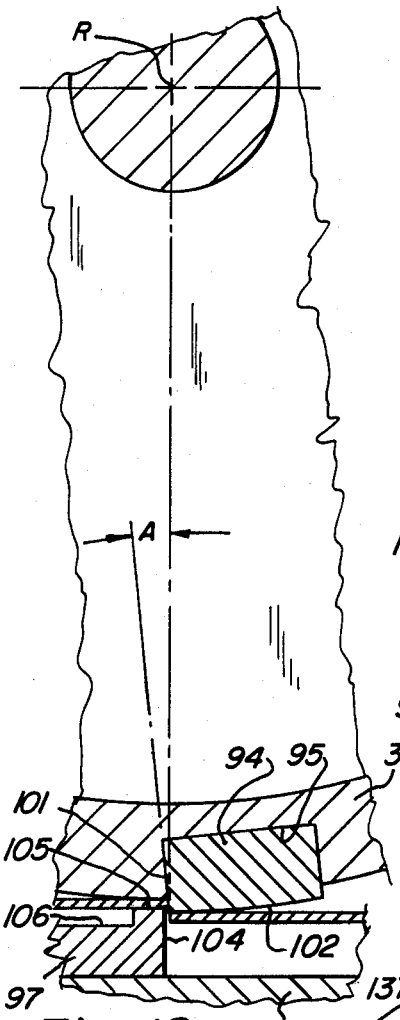
FIG. 19 is a side elevational view showing angular position of the shear blades.
Figure 20:
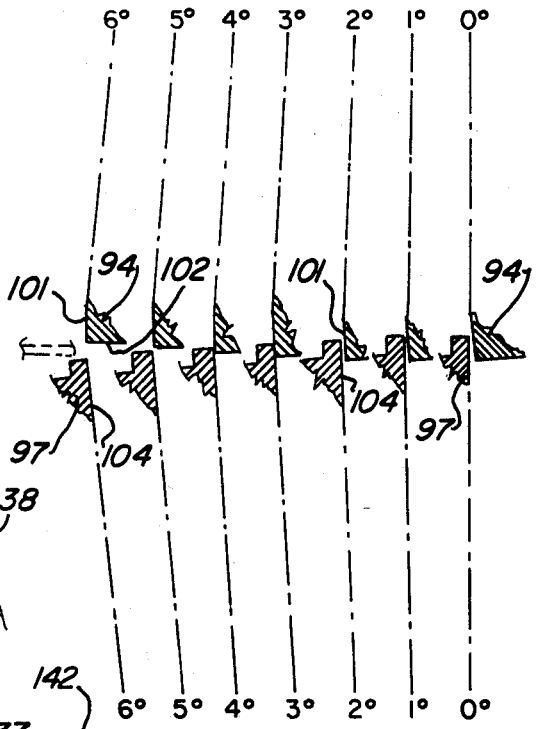
FIG. 20 is a fragmentary side elevational view illustrating the geometry of the shear blades.
Figure 18:
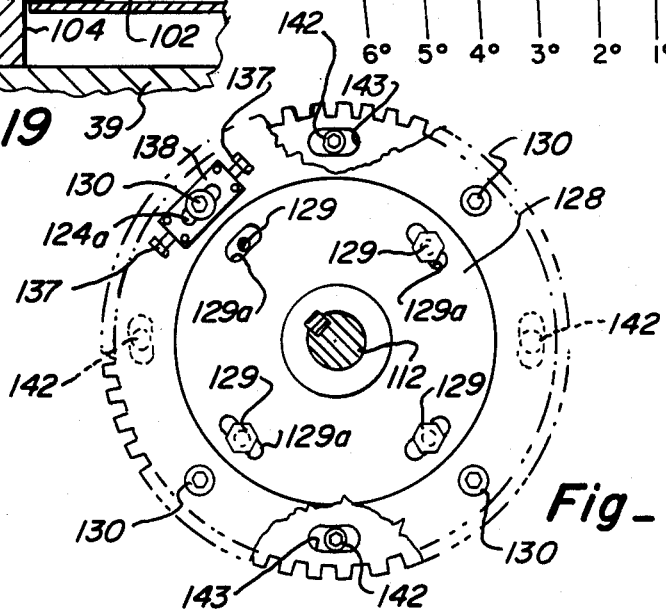
FIG. 18 is a sectional view taken along lines 18—18 of FIG. 13.
Figure 24:
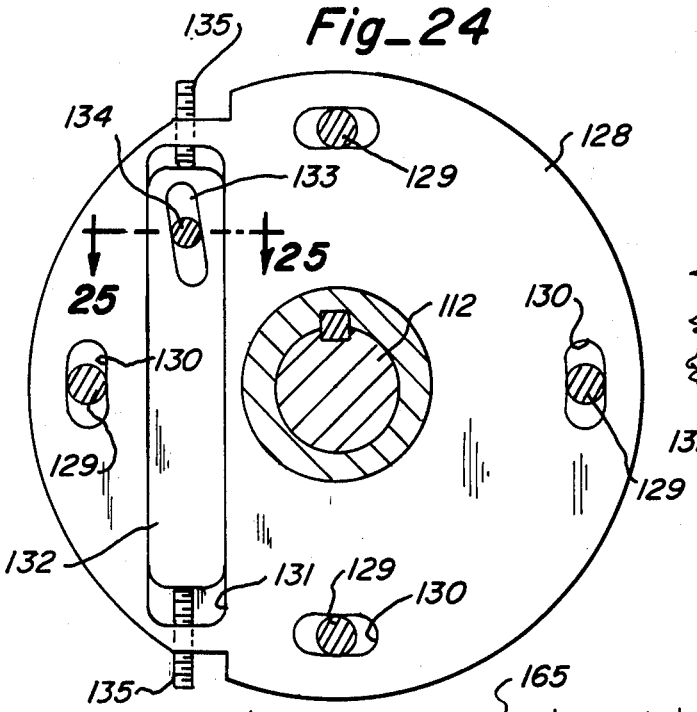
FIG. 24 is a sectional view taken along lines 24—24 of FIG. 13.
Figure 25:
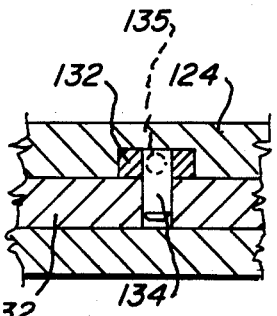
FIG. 25 is a sectional view taken along lines 25—25 of FIG. 24.

As best seen in FIGS. 19 and 20, each blade 94 and associated transversely extending shear face 101 together with associated recess 95 is rotated back at an angle A, preferably 6°, from a line normal to a radial line through the axis of rotation R of the shear drum 38. This rotation locates the top shear blade so that during rotation the top shear blade will not hit the lower shear blade. As best seen in FIG. 20, with the 6-degree rotation the blades just clear at 6°. The radially extending surfaces are substantially parallel at 3° and there is a maximum overlap when the center lines of the shear drums are alined at 0°.

The transversely extending face 102 includes an inwardly concave surface portion 108 formed on a radius and inclined surface portions 109 forming extensions of the concave surface portions. Inclined surface portions 109 are arranged at an angle of preferably 2° and may also be referred to as the rake surface portions.

As a result of the strip 31 passing through machine 27 there is formed therein a series of alined pairs of slits 110 opening along opposite longitudinal edges of the strip. These slits are formed by the inclined surface portions 109 of shear face 101 moving past the transverse surface portions 104. An intermediate scored portion 111 is formed between each pair of slits 110. This scored portion is formed between concave surface portion 108 and transversely extending surface 105 and holds the sheared portions together in such a way that they can be readily hand-twisted apart. A series of spaced indentations 51 are formed by the punching drums, shown as three between each successive slit 110.

The upper shear drum 38 is supported for rotation on an upper shaft 112 having its ends journaled in end bearings 113 in a slide block 114 with stepped side edges like block 56 above described for up and down guided movement in rectangular windows 115 in the side plates. The position of the slide blocks is adjusted by an externally threaded rod 116 that threads down into the slide block and is locked in position by lock nuts 117 similar to the adjustment for the upper punch drum as above described. The lower shear drum 39 is supported for rotation on a lower shaft 118 having its ends journaled in end bearings 119 in the side plates.

In the drive for moving the shear drums a lower gear 121 having teeth 122 is mounted on the lower shaft 118. An upper gear 123 of the split type including an outer gear portion 124 having teeth 125 and an inner gear portion 126 having teeth 127 are mounted on hub 128 on upper shaft 112. Hub 128 is keyed to the upper shaft 112. Circumferentially spaced bolts 129 extend through elongated slots 130 in the hub and through holes in the outer gear portion 124 to secure it to the hub.

The outer gear portion 124 has circumferentially spaced slots **124*a* through which a bolt 130 extends and threads into the inner gear portion 126. Set screws 137 in a block 138 on the outer gear portion are used to change the angular position of the outer gear with respect to the inner gear so that teeth 125 and 127** take up the full space between the teeth of the lower gear to avoid backlash, in the same manner as above described with respect to the punch drum gears.

An upper ring 141 connects between inner gear portion 126 and the upper drum 38 to transmit the movement of the upper gear to the upper shear drum. Similarly, a lower ring is connected between the lower gear and the lower shear drum to transmit the movement of the lower gear to the lower drum.

The connection between the inner gear portion 126 and the ring 141 is provided by circumferentially spaced bolts 142 that extend through elongated slots 143 in the inner gear portion and thread into internally threaded holes in the ring 14.

The outer gear portion further has a rectangular slot 131 that carries an adjustment bar 132 with an inclined slot 133 in which there is a pin 134 secured to the outer gear portion 124. The vertical position of the bar is set by upper and lower set screws 135 that will move the adjustment bar up and down. This enables the upper shear drum 38 to be rotated relative to the lower shear drum so that the radially extending shear faces 101 and 104 of the upper and lower shear blades, respectively, can be arranged substantially parallel when the surfaces are at the 3-degree setting shown in FIG. 19. In practice, a flat spacer gauge is placed between these surfaces during setup.

The roll-forming machine 28 produces a series of loosely connected hold-down clips 150 which pass from the roll-forming machine. Each clip has an upstanding portion 151, a top flange 152, and a bottom flange 153 with indentations 51. A two-piece hold-down clip shown in FIG. 22 has the bottom flange turned up to form a pocket 156 and the bottom piece has a base section 157 with indentations 51 and with a top bend 158 that fits over the pocket, as is fully described in my previously identified copending application.

Figure 26:
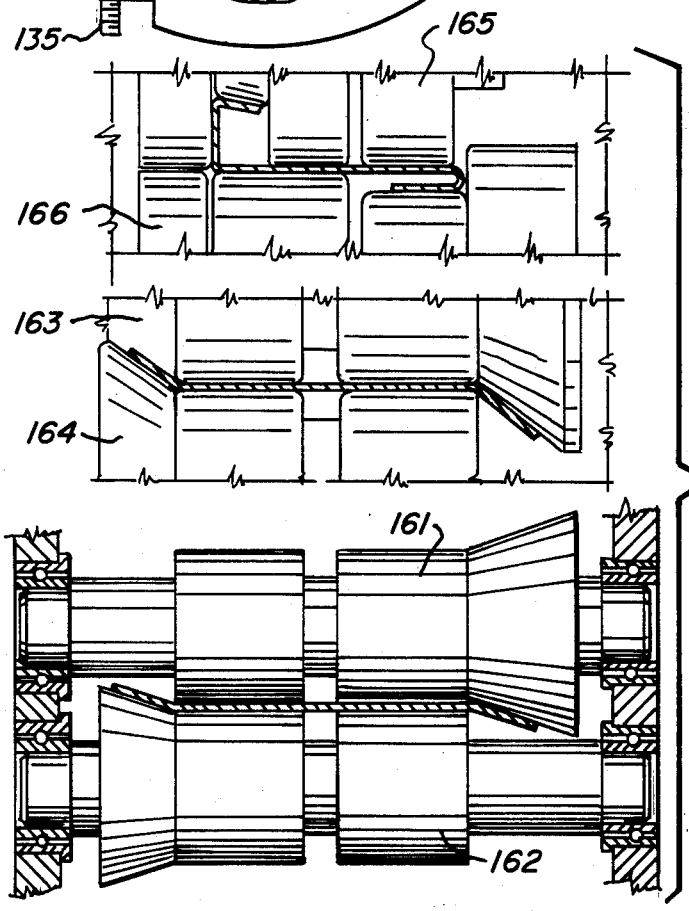
FIG. 26 is an end view showing the first, second and last roller stations of the roll-forming apparatus shown in FIG. 1.

The roll-forming machine 28 has a series of pairs of upper and lower rollers with a first pair 161 and 162, a second pair 163 and 164, and a last pair 165 and 166 shown in FIG. 26. These series of rollers gradually change the flat strip to the desired cross-sectional shape. The top piece of the two-part clip is formed in the same manner as the one-piece clip except that there are no indentations and the bottom flange is turned up.

In the operation of the above described apparatus the flat strip 31 is continuously fed into the machine 27 to be first indented by the punch drums and then sheared and scored by the shear drums to produce the product shown in FIG. 20. This product is then passed through the roll-forming machine 28 where it is shaped to form the strip of loosely connected hold-down clips shown in FIG. 22.

In use, a plurality of the formed strips can be hand-carried to the point of use and each clip broken off as its use is required.

By way of illustration and not limitation, the width of the strip 31 is 3 to 6 inches and the length is 36 to 38 inches. The strip material may be aluminum, steel, or precoated galvanized sheet metal, preferably of 22 to 28 gauge. The width of each article formed is preferably 3 inches.

Although the present invention has been described with a certain degree of particularity, it is understood that the present disclosure has been made by way of example and that changes in details of structure may be made without departing from the spirit thereof.

What is claimed is:

1. Apparatus for making a series of loosely connected articles from a strip of sheet material comprising:

a rotary shear having a set of shear drums each with a plurality of circumferentially spaced shear blades, each shear blade having a radially extending shearing face, cooperating pairs of said shear blades moving successively to opposite positions with opposite shearing faces overlapping as said set of drums is rotated to form along the length of said strip a series of alined pairs of slits opening along opposite longitudinal edges of said strip with an intermediate scored portion between each pair of slits as the strip is moved continuously between said set of rotary shear drums, one of said shear blades having an intermediate transverse surface portion and oppositely extending outer transverse surface portions forming extensions of said intermediate transverse surface portion and the other of said shear blades has a straight transverse surface portion, said outer transverse surface portions overlapping said straight transverse surface portion a distance greater than the thickness of the strip to provide offset opposite edges defining each slit that can be moved past one another when adjacent sections of the strip are bent about the associated intermediate scored portion to separate said sections by the application of twisting forces, and said intermediate transverse surface portion overlapping said straight transverse surface portion less than the thickness of the strip to only partially shear and weaken said strip in forming said intermediate scored portion.

2. Apparatus as set forth in claim 1 wherein one of said shear drums is rotatable relative to an associated support shaft through a range of adjustment and held at a selected setting for the alinement of said opposite of said radially extending shearing faces.

3. Apparatus as set forth in claim 1 wherein each of said shear blades on one of said shear drums is rotated back at a selected angle from a line normal to a radial line through the axis of rotation of the supporting shear drum to provide clearance for the radially extending shear faces of opposite pairs of said shear blades as they are rotated in relation to parallel axes.

4. Apparatus as set forth in claim 3 wherein said angle is about 6 degrees and said opposite radially extending shearing faces are substantially parallel when said opposite faces are about 3° from the maximum overlap shearing position.

5. Apparatus as set forth in claim 1 wherein said intermediate, transverse, surface portion is inwardly concave and said outer transverse surface portions are oppositely extending inclined rake surfaces.

6. Apparatus as set forth in claim 1 wherein said rotary shear includes:

a first shaft on which a first of said shear drums is mounted;

a second shaft on which a second of said shear drums is mounted; and drive means to rotate said drums in synchromism.

7. Apparatus as set forth in claim 6 wherein said drive means includes:

a drive motor;

a first gear on said first shaft;

a second gear on said second shaft meshing with said first gear;

first coupling means connecting said first shear drum to said first gear; and second coupling means connecting said second drum to said second gear, whereby, upon rotation of said second gear by said drive motor via a drive gear, said shear drums are driven in synchronism.

8. Apparatus as set forth in claim 7 including:

a first gear of the split type on said first shaft and a support hub on said first shaft, said first gear including:

a first gear portion with teeth affixed to said hub; and a second gear portion with teeth rotatable relative to said first gear portion through a range of adjustment and held at a selected setting so that the teeth of said first gear take up the full space between the teeth of the second gear to prevent backlash.

9. Apparatus as set forth in claim 1 further including a rotary punch inclusive of a set of rotary punch drums each with a plurality of circumferentially spaced punch dies, cooperating pairs of said punch dies moving successively to opposite positions as said drums are rotated to form a series of fastener-receiving impressions in said strip lengthwise of said strip as said strip is passed between said rotary punch drums.

10. Apparatus as set forth in claim 9 wherein one of said punch drums is movable relative to the other throughout a range of movement and held at a selected setting and one of said shear drums is movable relative to the other throughout a range of adjustment and held at a selected setting to accommodate strips of different thicknesses.

11. Apparatus as set forth in claim 9 wherein said rotary punch drums are mounted on first and second shafts, a first gear of the split type on said first shaft and a support hub on said first shaft, said first gear including:

a first gear portion with teeth affixed to said hub; and a second gear portion with teeth rotatable relative to said first gear portion through a range of adjustment and held at a selected setting so that the teeth of said first gear take up the full space between the teeth of the second gear to prevent backlash.

12. Apparatus as set forth in claim 9 wherein said set of punch drums is adjustable laterally throughout a range of movement and held at a selected setting to change the lateral position of the impressions in said strip.

13. A method of making a series of loosely connected articles from a strip of sheet material comprising the steps of:

shearing a strip of sheet material transverse thereto at spaced intervals to form a series of alined pairs of slits opening along opposite longitudinal edges while the strip is moved continuously along a pre-established course of travel and at the same time scoring an intermediate portion of the strip between each pair of slits by partially shearing and weakening said strip whereby the formed articles can readily be broken away by the hand-application of twisting forces, each said slit being defined by offset opposite edges positioned to move past one another when adjacent sections of the strip are bent about the associated intermediate scored portion to separate said sections by twisting.

14. Apparatus for making a series of loosely connected articles from a strip of sheet metal material that are readily broken apart by the hand-application of twisting forces thereto comprising:

a rotary punch including a set of rotary punch drums each with a plurality of circumferentially spaced punch dies, cooperating pairs of said punch dies moving successively to opposite positions as said drums are rotated to form a series of fastener-receiving impressions in a strip of sheet metal material as the strip is passed between said punch drums;

a rotary shear including a set of rotary shear durms each with a plurality of circumferentially spaced shear blades, each shear blade having a radially extending shearing face and a transverse shearing face, cooperating pairs of said shear blades moving successively to opposite positions with opposite, radially extending, shearing faces overlapping as said set of shear drums is rotated to form along the length of said strip a series of alined pairs of slits opening along opposite longitudinal edges of said strip with an intermediate scored portion between each pair of slits as the strip is moved continuously between said set of rotary shear drums;

one of said shear blades having an intermediate transverse surface portion and oppositely extending outer transverse surface portions forming extensions of said intermediate transverse surface portion and the other of said shear blades has a straight transverse surface portion;

said outer transverse surface portions overlapping said straight transverse surface portion a distance greater than the thickness of the strip to provide offset opposite edges defining each slit that can be moved past one another when adjacent sections of the strip are bent about the associated intermediate scored portion to separate said sections by the application of twisting forces; and said intermediate transverse surface portion overlapping said straight transverse surface Portion less than the thickness of the strip to only partially shear and weaken said stirp in forming said intermediate scored portion.

15. Apparatus as set forth in claim 14 wherein said roll-forming means includes a series of pairs of rollers that shape the strip into a hold-down clip for roof panels and the like.

* * * * *